US011482139B2

(12) United States Patent
Servaites et al.

(10) Patent No.: US 11,482,139 B2
(45) Date of Patent: Oct. 25, 2022

(54) LATCH FOR MOUNT AND DISMOUNT OF A MODULAR HOUSING

(71) Applicant: Vestaboard, Inc., Palo Alto, CA (US)

(72) Inventors: Jeffrey William Servaites, Oakland, CA (US); Jeffrey C. Weintraub, San Carolos, CA (US); Faiza Hassan, Fairbanks, AK (US); Ian Guyer, San Carolos, CA (US)

(73) Assignee: VESTABOARD, INC., Palo Alto, CA (US)

( * ) Notice: Subject to any disclaimer, the term of this patent is extended or adjusted under 35 U.S.C. 154(b) by 179 days.

(21) Appl. No.: 16/915,171

(22) Filed: Jun. 29, 2020

(65) Prior Publication Data

US 2021/0005116 A1 Jan. 7, 2021

Related U.S. Application Data

(60) Provisional application No. 62/869,490, filed on Jul. 1, 2019.

(51) Int. Cl.
*G09F 11/06* (2006.01)
*G09F 7/18* (2006.01)

(52) U.S. Cl.
CPC ..... *G09F 11/06* (2013.01); *G09F 7/18* (2013.01); *G09F 2007/1804* (2013.01); *G09F 2007/1843* (2013.01)

(58) Field of Classification Search
CPC .... G09F 11/06; G09F 7/18; G09F 2007/1804; G09F 2007/1843; F16M 11/04; F16M 11/041; Y10T 292/0894; Y10T 292/0895; Y10T 292/0901; Y10T 292/0902; Y10S 292/11; Y10S 292/63
USPC ..... 40/475; 368/222; 248/220.21, 221.11, 248/225.21, 222.11, 247, 300, 301; 361/679.58, 726
See application file for complete search history.

(56) References Cited

U.S. PATENT DOCUMENTS 5,289,651 A * 3/1994 Byers ..... G09F 11/06 40/500
2020/0327831 A1* 10/2020 Tenthorey ..... G09F 7/18

* cited by examiner

*Primary Examiner* — Jonathan Liu
*Assistant Examiner* — Rachel Mae Griffith
(74) *Attorney, Agent, or Firm* — Amin, Turocy & Watson, LLP

(57) ABSTRACT

A latching apparatus for mounting and dismounting a housing, such as a modular split flap housing for display, that releasably secures a plug-in modular unit against a corresponding back plate including latches for fastening and securing to a stationary panel and a sliding member that is slidable from a first unlocked offset position to a second locked offset position provided to stabilize the plug-in modular unit against a surface of the back plate.

18 Claims, 8 Drawing Sheets

LATCH FOR MOUNT AND DISMOUNT OF A MODULAR HOUSING

RELATED APPLICATION

The subject patent application claims priority to U.S. Provisional Patent Appln. No. 62/869,490, filed Jul. 1, 2019, entitled "Lockable Sliding Member for Split Flap Character Display Unit of Character Display Unit Array". The entirety of the aforementioned application is hereby incorporated by reference herein.

TECHNICAL FIELD

The subject application relates to latch mounting apparatus comprising a sliding lock member, and corresponding mounting (latching) and dismounting (unlatching) of a housing, such as a modular split flap housing.

BACKGROUND

Latch assemblies are relied on in many applications for securing items, such as panels, doors, and doorframes together. For example, containers, cabinets, closets, drawers, compartments and the like may be secured with a latch. Various latches for panel closures have been employed where one of the panels such as a swinging door, drawer or the like is to be fastened or secured to a stationary panel, doorframe, cabinet, or compartment body. However, there are drawbacks with conventional latch assemblies. Other contextual description may become further apparent from the following description of the various embodiments herein.

SUMMARY

The following presents a simplified summary of the specification in order to provide a basic understanding of some aspects of the specification. This summary is not an extensive overview of the specification. It is intended to neither identify key or critical elements of the specification nor delineate the scope of any particular embodiments of the specification, or any scope of the claims. Its sole purpose is to present some concepts of the specification in a simplified form as a prelude to the more detailed description that is presented in this disclosure.

The present application provides various embodiments for a latching apparatus, and related processes, for mounting a modular split flap housing for display of split flap characters or graphics. The latch releasably secures the plug-in rotor unit against a corresponding back plate when the housing and the back plate are latched together. A sliding member is provided to facilitate the locking and unlocking of the modular split flap housing, stabilizes the plug-in rotor unit in a locked position, and enables easy manual operation.

An example embodiment of the present application provides an apparatus, comprising a housing comprising a wheel within the housing, wherein the wheel is configured to spin about an axis; a group of split flaps hingeably disposed on an outer surface of the wheel; a first tab and a second tab accessible via a first opening and a second opening, respectively, of a rear side of the housing, wherein the first tab and the second tab are projections within the housing, and wherein the first tab and the second tab are configured to receive a first latch and a second latch, respectively, when the first latch and the second latch are inserted into the first opening and the second opening, respectively; a sliding member disposed with respect to the front, side, or back of the housing, wherein the sliding member comprises a first end, a second end, and an elongated section, wherein the second end and a portion of the elongated section are disposed within the housing, wherein the sliding member is configured to be slidable from a first unlocked offset position to a second locked offset position, wherein, in the second locked offset position, the second end secures a latch against the first tab, and wherein the sliding member is further configured to be slidable from the second locked offset position to the first unlocked offset position, wherein, in the first unlocked offset position, the latch is unsecured from the first tab as a result of movement of the second end away from the latch, enabling the apparatus to slide free.

Another example embodiment of an apparatus for mounting and dismounting a modular split flap housing relates to an apparatus, wherein the apparatus is configured to slide free of the latch at an angle with respect to an orthogonal direction from a surface comprising the first latch and the second latch.

Another example embodiment of an apparatus for mounting and dismounting a modular split flap housing relates to an apparatus, wherein the sliding member is disposed with respect to an interior surface of the side of the housing, and wherein, in the second locked offset position, the rear side of the housing is flush with a surface comprising the first latch and the second latch projecting from the surface.

Another example embodiment of an apparatus for mounting and dismounting a modular split flap housing relates to an apparatus, wherein, in the second locked offset position, the second end securing the first latch against the first tab further results in the second latch being pressed against the second tab to secure the second latch against the second tab, and wherein, in the second locked offset position, movement of the first latch is substantially prevented relative to the first tab and movement in the second latch is substantially prevented relative to the second tab.

Another example embodiment of an apparatus for mounting and dismounting a modular split flap housing relates to an apparatus, wherein the sliding member is disposed parallel or substantially parallel to an interior surface of a top side of the housing.

Another example embodiment of the apparatus for mounting and dismounting a modular split flap housing relates to an apparatus, wherein the first end extends externally from a front side of the housing in a direction from the rear side of the housing to the front side of the housing, or wherein the first end extends externally from a left side of the housing in a direction from the right side of the housing to the left side of the housing, or wherein the first end extends externally from a right side of the housing in a direction from the left side of the housing to the right side of the housing.

Another example embodiment of an apparatus for mounting and dismounting a modular split flap housing relates to an apparatus further comprising a motor disposed within the wheel, wherein the motor is operable to spin the wheel by different fixed amounts of angular rotation respectively corresponding to a split flap of the group of split flaps.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

Figure 1:
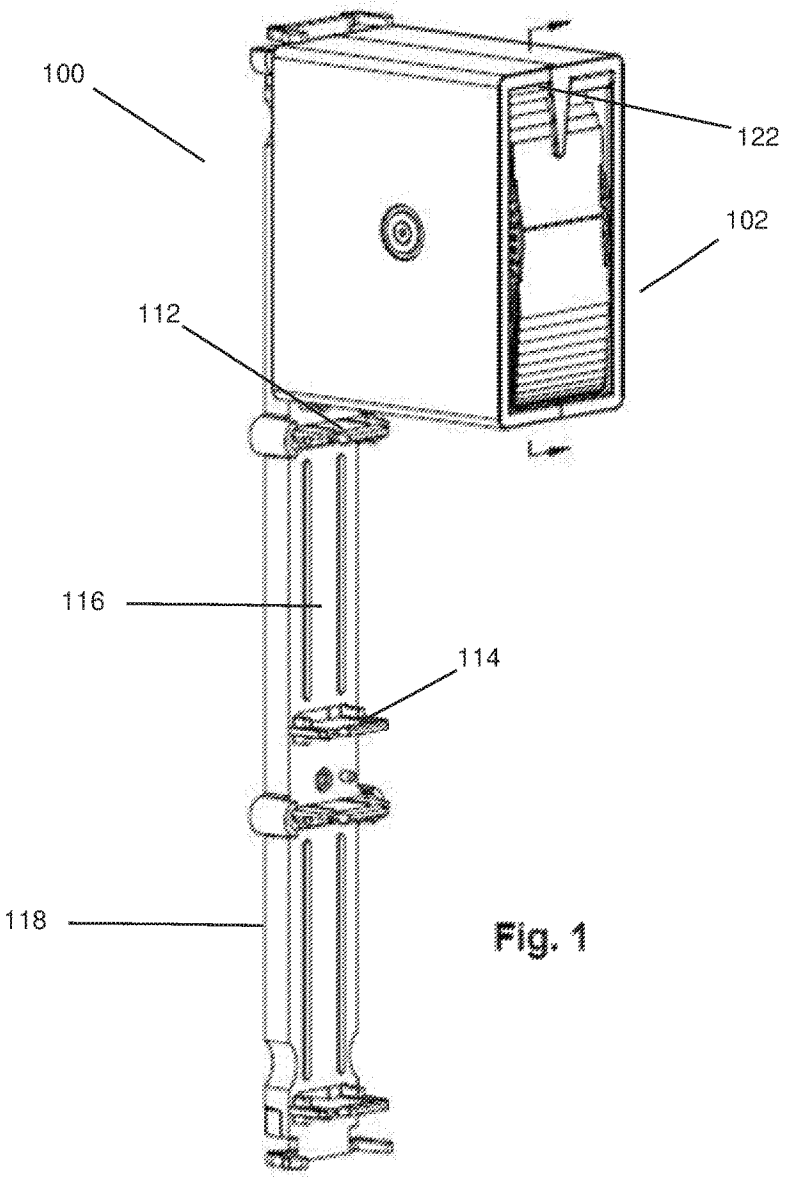
FIG. 1 illustrates a perspective view of an example embodiment of an apparatus for mounting and dismounting a modular split flap housing, wherein the housing is in a locked position.
Figure 2:
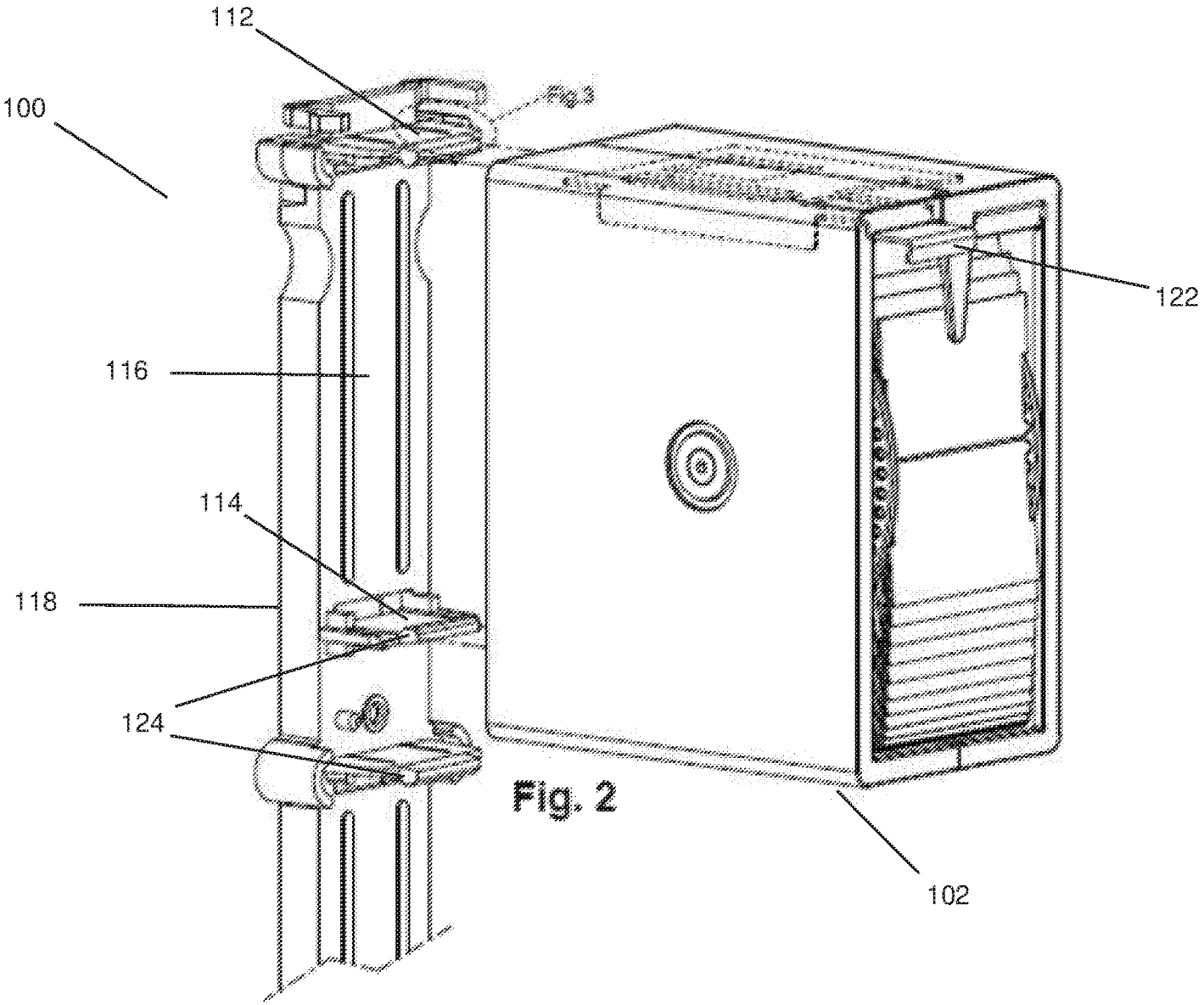
FIG. 2 illustrates a perspective view of an example embodiment of an apparatus for mounting and dismounting a modular split flap housing, wherein the housing is away from the mount.

Referring to FIGS. 1 & 2, a first embodiment of an apparatus for mounting and dismounting a modular split flap housing 100 is shown. FIG. 1 illustrates the apparatus in a mounted configuration where the modular split flap housing 100 is mounted. FIG. 2 illustrates the apparatus in a dismounted configuration where the modular split flap housing 100 has been dismounted. In the embodiment shown, the apparatus comprises a latch and lock combination. In alternate embodiments, the apparatus for mounting a modular split flap housing may be another suitable type of latch apparatus, such as a deadbolt latch, a ball catch, a magnetic latch, or the like.

In the illustrated example, the apparatus for mounting and dismounting a modular split flap housing 100 includes a housing or support structure 102, a first extension or latch 112, a second extension or latch 114, a surface of the back plate 116, and a sliding member 122, also referred to herein as a user interface element. A housing 102 is mounted on the surface the back plate 116. In the illustrated example, the housing 102 is securely installed in a locked position (FIG. 1). Alternatively, the housing 102 may be removed from the mount (FIG. 2).

Two extensions or latches (112, 114) are positioned on the surface of the back plate 116. In FIG. 1, the extensions or latches (112, 114) are configured as projections, although other configurations are contemplated. The extensions or latches (112, 114) are secured on the surface of the back plate 116 and are shown protruding outward to allow mounting of the housing 102. The housing 102 also comprises a sliding member 122 positioned on a front surface of the housing 102. In some embodiments, the sliding member 122 may be positioned on the side of the housing 102.

The sliding member 122 is movable from a first unlocked position to a second unlocked position to a locked position. When the sliding member 122 is closed and the sliding member 122 is in the locked position, the housing 102 is secured to the surface of the backplate 116. The extensions or latches (112, 114) insert into respective openings and interface with and is secured to respective snaps in the housing 102. The extensions or latches (112, 114) protrude through openings on the back side of the housing 102 because of the influence of the rotor unit within the housing 102.

According to one aspect of one or more of the various embodiments described herein, the housing 102 is sized such that the frame will fit within a rack mount configuration. Standard rack-mount systems are well-known in the art and are available from a variety of vendors. Such rack-mount systems are typically used to house server and telecommunication equipment and cabling within the data center, and generally have a set horizontal distance between vertically-oriented rails to which equipment is mounted.

Although a particular number of module bays are shown, the various embodiments described herein are not limited to any particular number or combination of bays. Rather, any number and configuration of module bays may be used.

In the example embodiment, the housing 102 and the back plate 116 are substantially parallel one to the other, and substantially perpendicular to the extensions or latches (112, 114), the extensions or latches (112, 114) being substantially parallel one to the other. The back plate 116 is substantially I shaped and is adapted to allow the housing 102 to be fed to a space in front of the rack mount 118. The back plate 116 comprises the extensions or latches (112, 114), which are adapted to facilitate fastening the housing 102 thereto. The housing 102 comprises openings, which are adapted to facilitate fastening the rack mount 118 thereto.

The rack mount 118 is preferably of knock down construction; however, certain portions of the rack mount 118 may alternatively be of unitary construction. The rack mount 118 is capable of being assembled quickly and easily. The rack mount 118 may be of metal, such as aluminum or steel, thermoplastics, thermosetting polymers, rubber, or other suitable material or combination thereof. The rack mount 118 may be painted or left in an as-is condition.

The back plate 116, which is I shaped, comprises a substantially planar portion and the extensions or latches (112, 114) extending therefrom. The substantially planar portion is substantially centrally disposed in the back plate 116. The substantially planar portion comprises the extensions or latches (112, 114) extending therefrom, which are adapted to facilitate fastening the housing 102 thereto. The extensions or latches (112, 114) comprise substantially trapezoidal projections or hooks 124 for fastening the back plate 116 thereto the rear side of the housing 102. The position of the housing 102 is adjusted thereon the extensions or latches (112, 114), and the sliding member 122 is fastened thereto the front side of the housing 102. The sliding member 122 can be slid to the fastened position with finger pressure.

The sliding member 122 is movable between a lock position protruding inward in the horizontal depth direction of the sliding member 122 and a lock release position retracted outward in the horizontal depth direction. This moving direction is a direction orthogonal to the back plate 116 and the rack mount 118.

When the sliding member 122 is in the unlocked position, the rear side of the housing 102 moves towards the back plate 116 when the sliding member 122 moves rearward. When the sliding member 122 further moves rearward, the housing 102 is in contact with the back plate 116. Then, the extensions or latches (112, 114) move to the locked position against the urging force of the projections. The projections have such a rigidity that it does not deform inadvertently when the sliding member 112 is pushed. If the unlock position is formed by the sliding member 122, the extensions or latches (112, 114) can be pushed to the lock position.

When the sliding member 122 is in the locked position, the rear side of the housing 102 moves away from the back plate 116 when the sliding member 122 moves frontward. When the sliding member 122 further moves frontward, the housing 102 is detached from the back plate 116. The extensions or latches (112, 114) move to the unlocked position against the urging force of the projections. The projections have such a rigidity that it does not deform inadvertently when the sliding member 122 is pulled. If the locked position is formed by the sliding member 122, the extensions or latches (112, 114) can be pulled to the unlock position.

Figure 3:
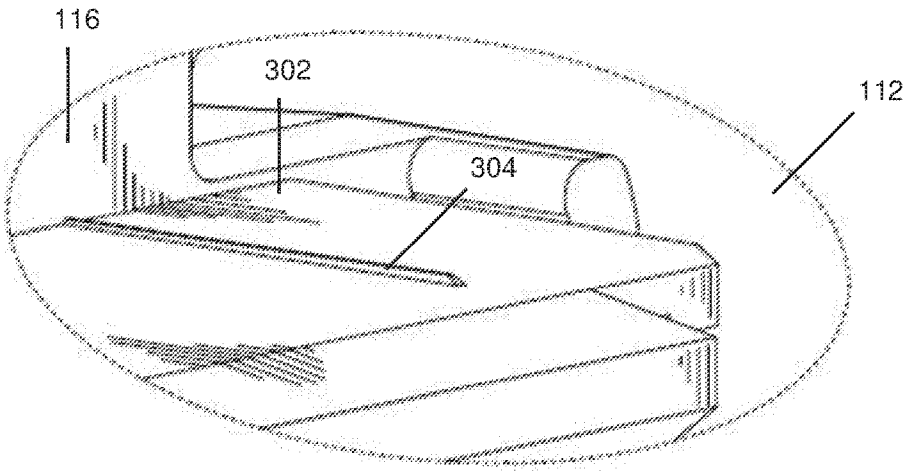
FIG. 3 illustrates a cut away view of an example embodiment of a collapsible rib bar on a latch.

Referring to FIG. 3, the extensions or latches (112, 114) comprise a mounting side 302 and a catching side. The mounting side 302 comprises at least one raised collapsible rib 304 projecting along the length as shown on the first latch 112. The rib 304 begins from the backplate 116 and extends to at least half the length of the extensions or latches (112, 114).

The straight state of this device as shown in FIG. 3 straight bars are arranged on a bore straight structure. The straight bar assembles mutually by adopting groove structure shown in FIG. 3 to connect the extensions or latches (112, 114) with the housing 102, constitutes the integral rigidity structure that can draw in, launch. The rib 304 connects the joint and adopts mechanisms that torsion spring drives. The rib mechanism may constitute metal, such as aluminum or steel, thermoplastics, thermosetting polymers, rubber, or other suitable material or combination thereof.

The contact rib 304 that forms the contact extend in the direction of the conductor track or in the direction of the extensions or latches (112, 114), so that the insertion required to introduce the extensions or latches (112, 114) into the housing 102 and the contact surface of the structure the force is kept relatively small. The contact rib 304 further acts as a guide when inserting the extensions or latches (112, 114). On the other hand, sufficient contact force or planar pressure can be achieved at the contact points. Thus, according to one or more of the various embodiments described herein, these two fundamentally conflicting requirements can be combined into one another.

According to an embodiment of the present application, the contact surface is flat and the contact rib 304 extends linearly along the longitudinal axis of the extensions or latches (112, 114). The rib 304 extends parallel to the contact surface plane in the tightening position. This achieves a large contact length along the longitudinal axis of the housing 102.

Alternatively, the contact surface can be convexly curved along the longitudinal axis of the housing 102 in the direction of the extension or latch 112. In this embodiment, preferably the radius of curvature may slightly penetrate the extension or latch 112 along the longitudinal axis of the housing 102 to which the contact rib 304 is tightened and over the length extended along the longitudinal axis. The edge of the contact rib 304 is configured with such an acute angle. However, depending on the application, it may be desirable that the contact length of the rib 304 be shortened by bending. In some cases, it may be advantageous to configure the contact surface in a spherical (two-dimensional convex) or saddle shape.

The number of contact ribs can preferably range from about 2 to about 8. Thereby, on the one hand, a sufficient contact force is obtained, and on the other hand, a sufficient frictional coupling against the housing 102 is obtained. However, in some cases, it is not excluded to provide at least two or three contact ribs.

The structure of apparatus of the various embodiments described herein is not limited to the above-mentioned example. The contact rib draws bore in and draws height in. The rib bar sectional dimension parameter is determined by the deployable ground plane device in space. According to concrete specifics, its development size can cover several millimeters to up to a hundred millimeters of bores and can be scaled to size even larger. Torsion spring type of drive of the various embodiments described herein also can adopt motor-driven according to concrete specifics and can also drive and control by trailing cable.

Figure 4:
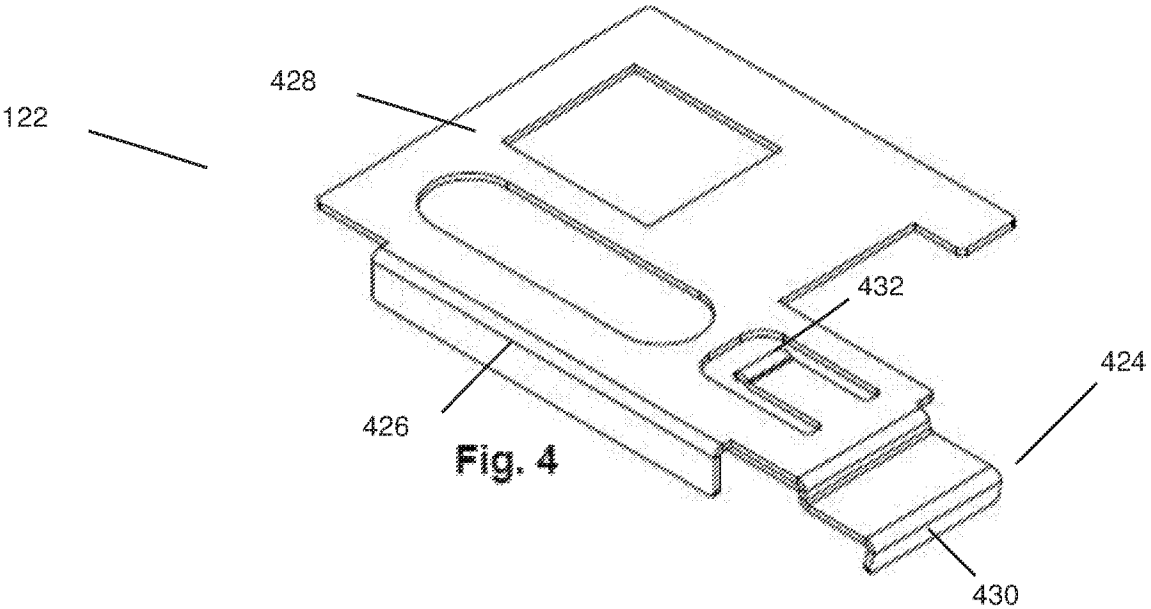
FIG. 4 illustrates a blow up view of an example embodiment of a sliding member.

Referring to FIG. 4, the sliding member 122 has a first end 424, an elongated section 426, a second end 428, a curved flange 430, and a bump 432. The sliding member 122 is a user interface element extendable from the housing 102 configured to be pulled or pushed by external force. According to the external force to the user interface element, the sliding lock is slidable between a first position and a second position.

The first end 424 comprises a curved flange 430 for use as a user interface element extendable from the housing structure configured to be pulled or pushed by external force The curved flange 430 and a portion of the elongated section 426 are disposed within the housing structure.

When the sliding member 122 is in the first position, the curved flange 430 is withdrawn away from pressing on the surface of the rear wall of the surrounding structure, resulting in the first corresponding geometry of the bump 432 being mated with a first geometry of the structure, and further resulting in the second corresponding geometry of the structure being unmated from the bump 432.

When the sliding member 122 is in the second position, the curved flange 430 is pressed against a surface of the rear wall of the surrounding structure, resulting in the bump 432 being pressed against, and mated to the second corresponding geometry of the structure, and further resulting in the first corresponding geometry of the structure being unmated from the bump 432.

The sliding member 122 is suspended by and supported by a plurality of support members. Although one configuration of the sliding member 122 is illustrated, the various embodiments described herein may be used with any type or configuration. An elongated section 426 is specifically received in and/or secured in a receptacle of the structure. See FIG. 5A. This receptacle is particularly machined or sized and located to receive, mate and/or hold the sliding member 122 of the apparatus. The receptacle furthermore is located and sized so that the sliding member 122 may fit snugly inside the structure without moving or shifting during operation. Although one configuration is illustrated and described, the various embodiments described herein may be used to store and ship other configurations of product not shown or described. Similarly, depending on the configuration of the product, the sliding member 122 may be shaped or configured differently than shown and described.

The sliding member 122 of the various embodiments described herein is adapted so that an operator located at the front side 518 of the display housing may pull a modular split flap housing to be removed from the front side 518 of the apparatus forwardly to a more ergonomically friendly position from a row of modules suspended by and contacting the two adjacent modules, named proximal and medial modules for purposes of this document, have been unloaded or removed. Thus, a person unloading the module from the front side 518 or proximal location of the container will not have to stretch or reach to the back of the module.

Similarly, a person loading the module from the front side 518 of the display housing need not stretch or reach to the back of the display housing to insert or load a module into the structure. The loader of the module may push the sliding member 122 already loaded with rows of modules rearwardly and load additional modules in a more ergonomically friendly position or manner. For example, after a module is loaded, the sliding member 122 is pushed rearwardly to enable the bump 432 to lock. Thus, the various embodiments described herein allow modules to be more efficiently and safely removed from these containers or inserted therein without unnecessary stress or strain on the unloader or loader.

Moreover, because the sliding member 122 is located at or near the top of the module, modules may be easily accessed. In other words, the sliding member 122 keeps the product in an optimum location for removal by an unloader or insertion by a loader.

Similarly, modules may be easily and quickly loaded into a reusable and returnable display housing using the one or more embodiments of the various embodiments described herein. A loader first loads a module so that the module is suspended between opposing modules, the first module being located in a distal position and the module being located in a medial position. Once a row of modules has been suspended along with the distal and medial modules, the distal and medial modules are fixed so that another row of modules may be loaded into the display housing. If the display housing contains additional rows of modules, the process continues until all modules of the display housing have been loaded.

The sliding member 122 may constitute metal, such as aluminum or steel, thermoplastics, thermosetting polymers, rubber, or other suitable material or combination thereof.

Figure 5A:
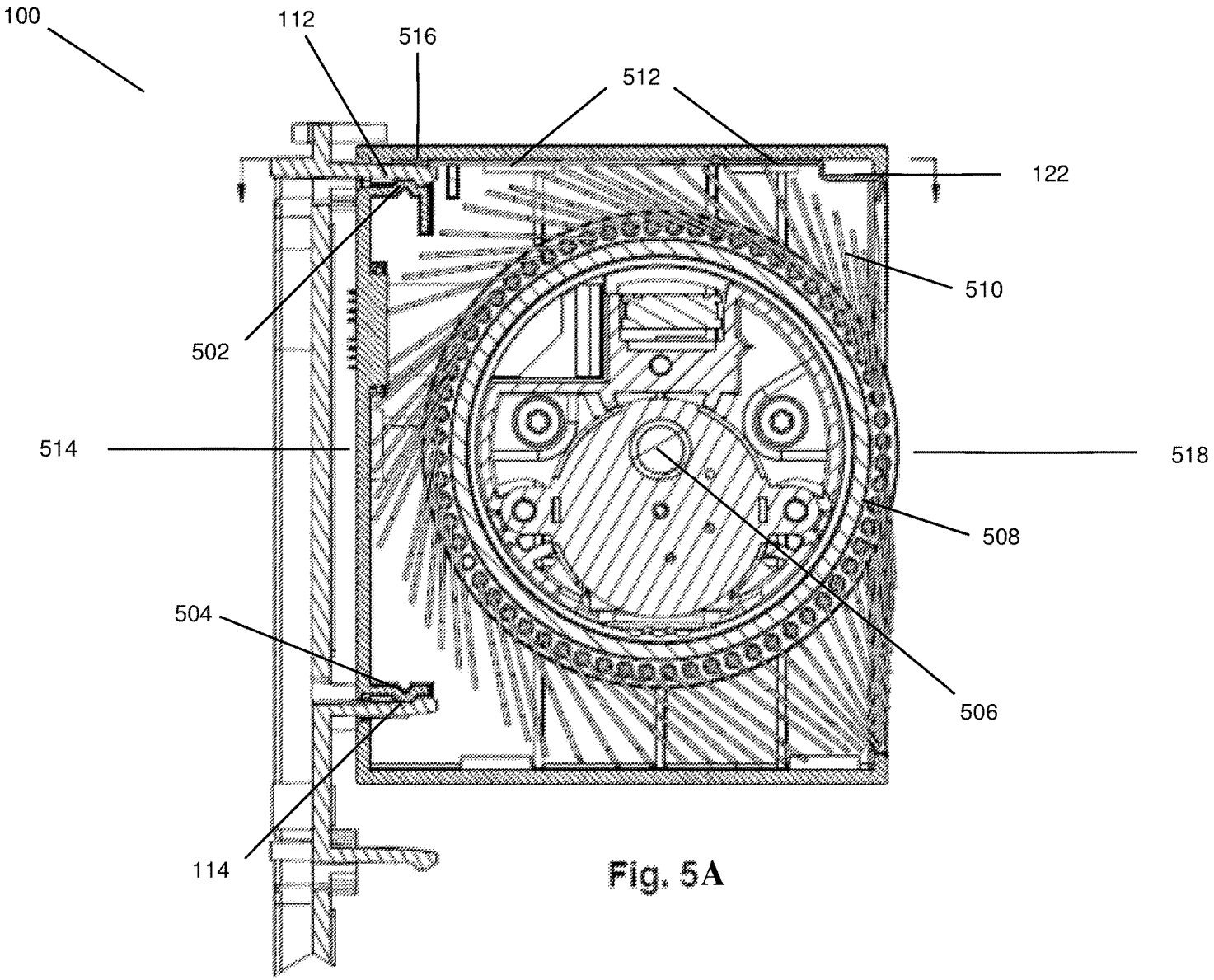
FIG. 5A illustrates a side view of an example apparatus for mounting and dismounting a modular split flap housing in the locked position.

FIG. 5A is a perspective view of an apparatus for mounting a modular split flap housing 100 in a snapped in and locked configuration. The sliding member 122 can slide in a sliding direction relative to the housing 102 and slide in the reverse direction. In the snapped in position, the first extension or latch 112 is mated with the first tab or snap 502 and a second tab or snap 504 is mated with the second extension or latch 114. The sliding member 122 is in the locked position shown in FIG. 5A to secure the housing 102. In the illustrated embodiment, the rotor unit 506 includes a wheel and a group of split flaps $\mathbf{510}_{1\text{-}N}$. In other embodiments, the rotor unit 506 can include other suitable display components. The rotor unit 506 can also include additional electronic and/or mechanical subcomponents positioned proximate to the rotor unit 506. The tabs or snaps (502, 504) are particularly useful because they are an easy and efficient way to secure a display module into the housing 102.

The tab projection forming the extensions or latches (112, 114) are elongated with an enlarged head at its distal end which reversibly snaps into the corresponding tabs or snaps (502, 504). The tabs or snaps (502, 504) are preferably an injection molded part constructed out of acrylonitrile-butadiene-styrene "ABS", Acetal, Acrylic or Nylon. However, depending on the intended use, materials such as polycarbonate, polypropylene or polyurethane may be substituted. The alignment tabs or snaps (502, 504) prohibit the type of movement common to latch panels which are connected via an extruded latch which mount together via a slide-in function. Additionally, as shown in FIG. 5A the tabs or snaps (502, 504) form a buttress between panels enhancing the structural integrity of the structure.

The enlarged head formed on the extensions or latches (112, 114) is shown mated firmly within the tabs or snaps (502, 504), by constructing the catch out of a material with sufficient lubricity, flexibility and/or memory, the enlarged head may be withdrawn or snapped-out of the tabs or snaps (502, 504) by displacing the housing 102 which can snap-back, undamaged, upon withdrawal. Sufficiently flexible extensions or latches (112, 114) also places less stress on the enlarged head of latches (112, 114) thereby minimizing the risk of neck damage during attachment or detachment of panels.

FIG. 5A illustrates the position of the sliding member 122 which inhibits movement of the extensions or latches (112, 114) within the tabs or snaps (502, 504) thereby enhancing the structural integrity of the structure. Surrounding the sliding member 122 are support edges which engage an adjacent support edge of the housing 102 affixed adjacent and forms the larger corner support. Support guides 512 are formed opposite the support edges. It is via the support guides 512 that the siding member 122 is fitted into the receptacle. It is envisioned that each guide will be solidly affixed to the housing 102. The nature of the attachment will be dependent on the material of which the panel is constructed; adhesives, locking tabs, sonic welds, glue, rivets, crimping and the like may be used.

The first extension or latch 112 comprises a raised element with a ramped end portion 516 that facilitates sliding of the sliding member 122 between the first position and the second position, via the first ramped end portion 516 making initial ramped contact with the second end 428 of the sliding member 122 during sliding.

Figure 5B:
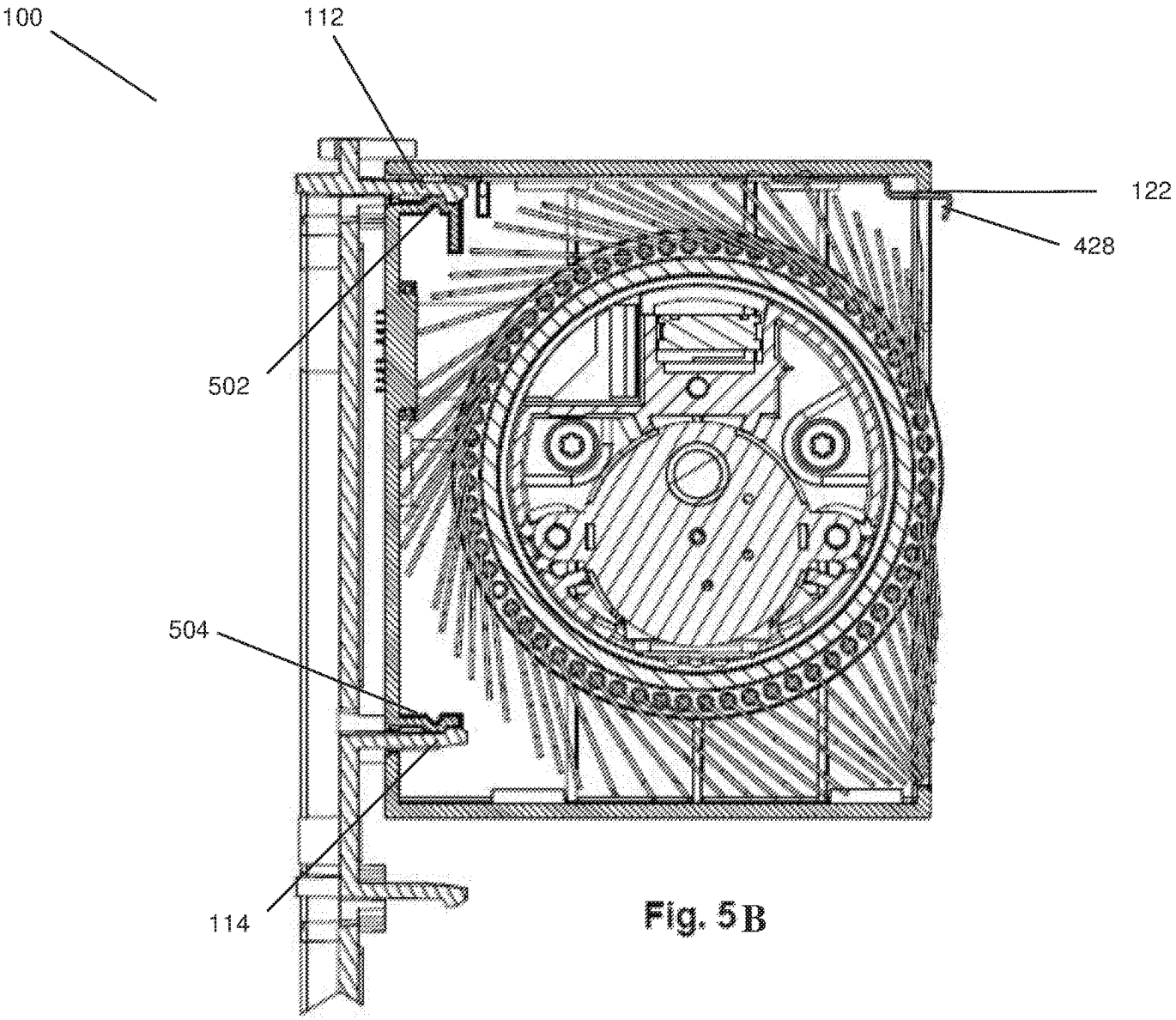
FIG. 5B illustrates a side view of an example apparatus for mounting and dismounting a modular split flap housing in the unlocked position.

FIG. 5B illustrates the position of the sliding member 122, which allows movement of the extensions or latches (112, 114) within the tabs or snaps (502, 504) thereby easing the structural integrity of the structure. The first end 424 of the sliding member 122 extends away from the housing 102 due to being pulled by an external force. The sliding member 122 thereby is placed in the unlocked position.

In the first unlocked position in FIG. 5B, exerting a pulling force outward from the housing, to create movement of the back end and the flange of the body, has released the housing from being secured to a surface of a back plate as a result of the tabs or snaps (502, 504) having released from a pressure on the extensions or latches (112, 114).

In the first unlocked position, the housing 102 is configured to slide free from the surface of the back plate at an angle with respect to an orthogonal direction from the surface of the back plate.

In the second locked position in FIG. 5A, exerting a pushing force to the housing, to create an opposite movement of the back end and the flange of the body, has secured the housing to the surface of the back plate as a result of the extensions or latches (112, 114) having exerted the pressure on the tabs or snaps (502, 504).

A component of the housing 102 is an electrical connection and a data connection is established between a component of the back plate and of the housing. In response to disengagement of the electrical connection and the data connection from the component of the back plate, the disengagement can be detected and can result in a transmission of an alert message to a user device.

The rotor unit 506 is disposed within the wheel 508. The rotor unit 506 is operable to spin the wheel 508 by different fixed amounts of angular rotation respectively corresponding to a split flap 510 of the group of split flaps.

Figure 6:
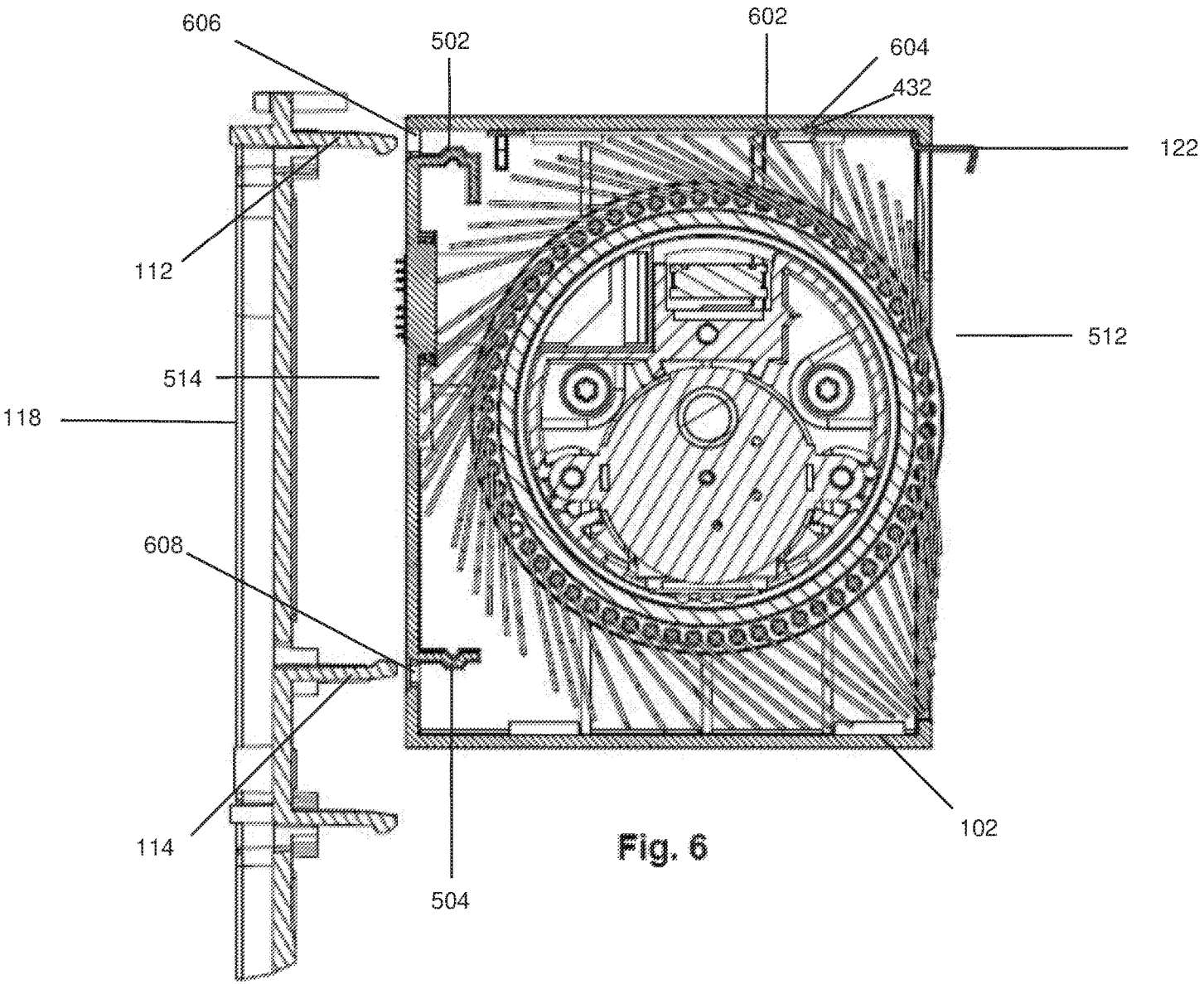
FIG. 6 illustrates a side view of an example apparatus for mounting and dismounting a modular split flap housing having the module removed from the mounting rack.

Referring to FIG. 6, a first bump is located near the first end of the sliding member 122 and a second bump is located towards the second end of the sliding member 122. In the first position of the sliding member 122, the bump 432 snaps into a first depression 602 of the housing near the first end of the sliding member 122. In the second position, the bump snaps into a second depression 604 of the housing toward the second end of the sliding member 122, but farther than the first depression from the first end.

The mating elements for the extensions or latches (112, 114), e.g., the tabs or snaps (502, 504), are accessible via a first opening 606 and a second opening 608, respectively, of the housing 102, wherein the first mating element and the second mating element are configured to receive a first extension or latch 112 from a mounting rack 118 and a second extension or latch 114 from the mounting rack 118, respectively, wherein the first extension or latch 112 has a first geometry configured to match a first corresponding geometry of the first tab or snap 502, and wherein the second latch 114 has a second geometry configured to match a second corresponding geometry of the second tab or snap 504.

In the first position, the extensions or latches (112, 114) are withdrawn away from the housing 102, resulting in the first corresponding geometry of the first extension or latch 112 being unmated from the first geometry of the first tab or snap 502, and further resulting in the second corresponding geometry of the second extension or latch 114 being unmated from the second geometry of the second tab or snap 504.

The sliding member 122 extends externally from the front side 518 of the housing 102 in a direction from the rear side 514 of the housing to the front side 518 of the housing.

Figure 7:
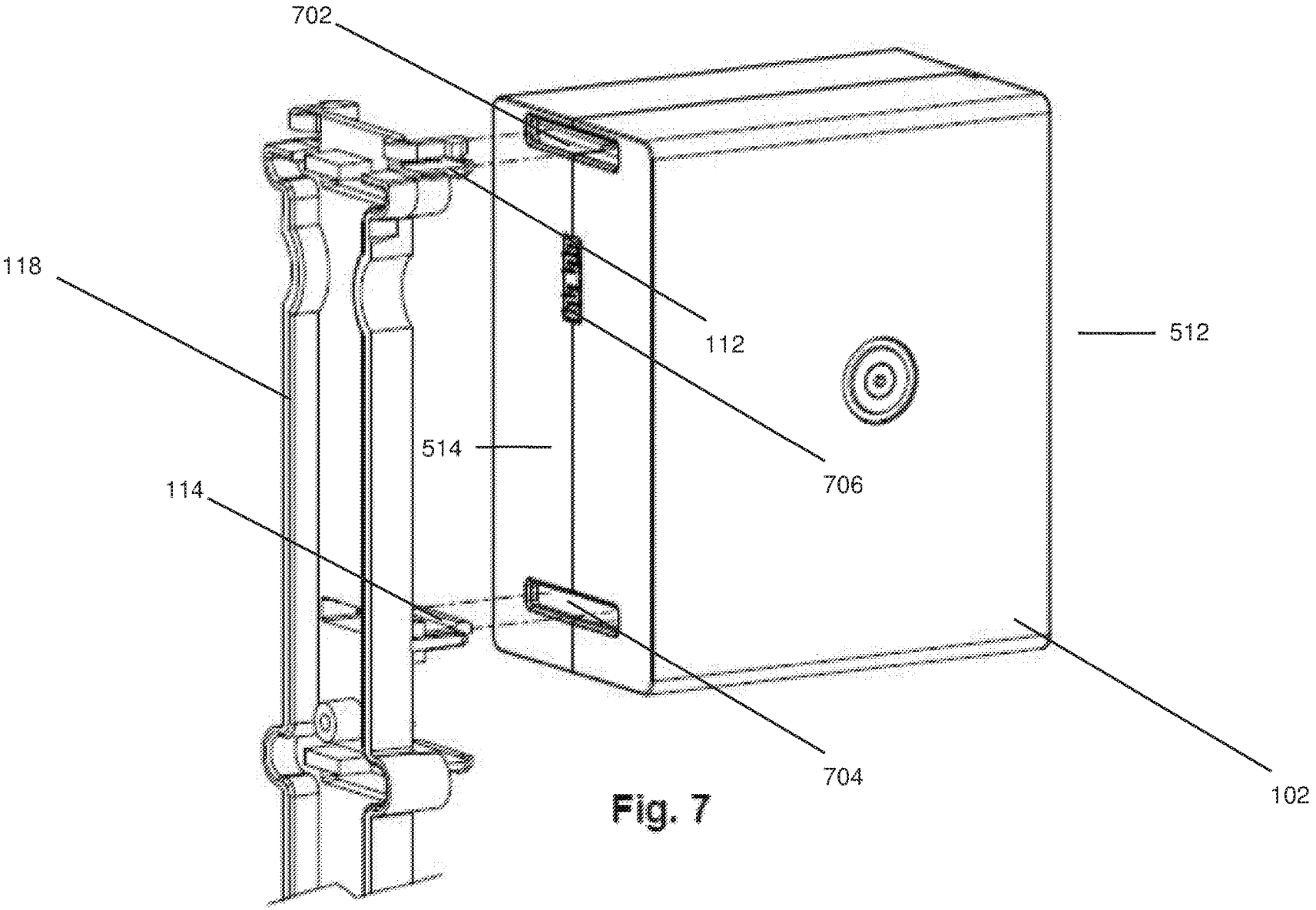
FIG. 7 illustrates a perspective view of an example apparatus for mounting and dismounting a modular split flap housing having a module removed from the rack mount.

Referring to FIG. 7, cavities (702, 704) is provided at the rear side 514 of the housing 102. The cavities (702, 704) are adapted to receive the extensions or latches (112, 114). By configuring as above, the rack mount 118 is adapted to insert into the cavities (702, 704) upon applying an external pushing force to the housing 102 to the extensions or latches (112, 114) of the rack mount 118. A plurality of input/output (I/O) ports 706 of different functions (e.g., power jack, USB port, RJ-11 port for connecting to network, RJ-45 port for connecting to network, etc.) are provided at the other rear side 514 of the housing 102. A plurality of corresponding connectors are adapted to couple to the I/O ports. By configuring as above, the extensions or latches (112, 114) will not be fastened in the cavities (702, 704) if the insertion of the input/output (I/O) plugs the input/output (I/O) ports 706 is not correct. The locking of the housing 102 is made possible only by correctly sliding the extensions or latches (112, 114) along the cavities (702, 704) respectively and pushing the sliding member after snapping the extensions or latches (112, 114) in the above operation.

By configuring as above, it is seen that a loader or unloader can manipulate the apparatus to detach the housing 102 from the rack mount 118 when the module is not in use, for example, inoperative. At this time, the rear side 514 of the housing 102 is exposed. Next, insert one end of the housing 102 comprising the cavities (702, 704) and the input/output (I/O) ports 706 into the rack mount 118 with the extensions or latches (112, 114) already being aligned to the I/O ports 706 between the extensions or latches (112, 114). Once the extensions or latches (112, 114) are firmly inserted into the rack mount 118, the module is able to operate.

In brief, a characteristic of one or more embodiments of the various embodiments described herein is the exchangeability of the modules with a replacement module. Also, the plurality of I/O ports 706 of different functions are provided at the rear side 514 of the housing 102 with the extensions or latches (112, 114) being already aligned to the I/O ports 706. By configuring as above, it is possible of inserting housing 102 into the rack mount 118 due to the removal of an inoperative module from the rack mount 118. The module is then able to communicate with the system. This eliminates the tedious, repeated process of detaching fasteners from the housing 102. Moreover, an exchangeability of the modules and a simple operation are carried out by the invention. In addition, the invention has the benefits of simple construction, no interference between two mechanisms, and being ergonomic without the disadvantages of conventional systems.

Figure 8:
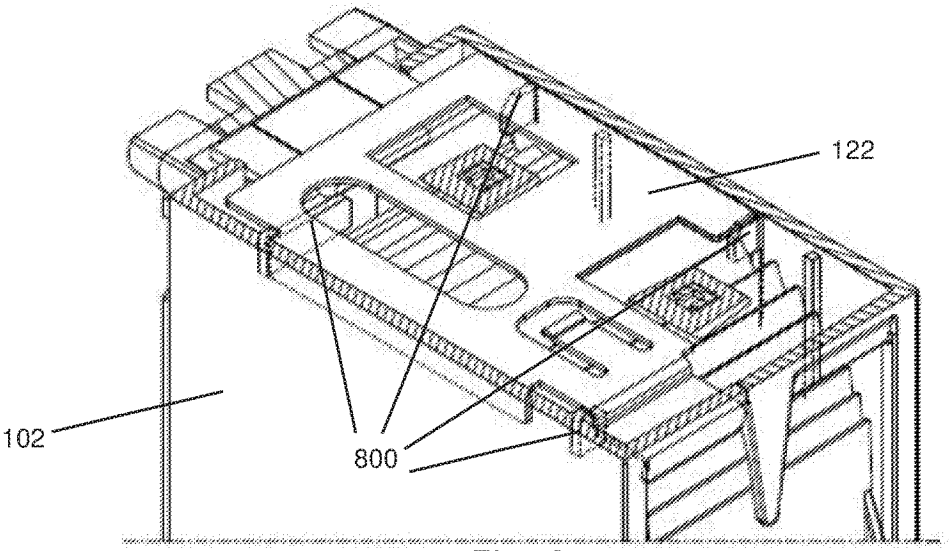
FIG. 8 illustrates a perspective view of a sliding member in relation to support members.
Figure 9:
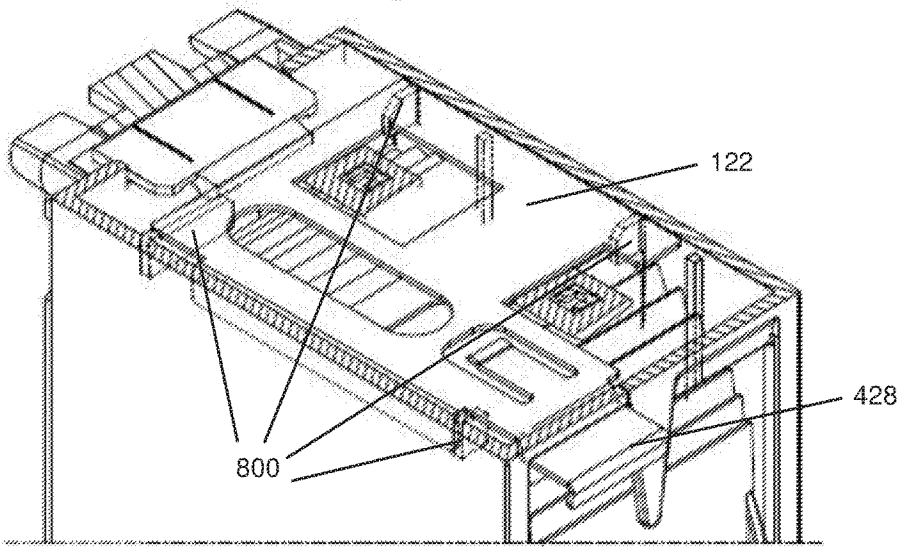
FIG. 9 illustrates a perspective view of a sliding member in relation to support members.

As shown in FIGS. 8 & 9, various embodiments described herein provide for a sliding member that may be mounted differently than traditional slides. Specifically, the sliding member 122 may be encased in the housing 102 with the sliding member 122 being supported by a plurality of support members 800. One benefit of this kind of mounting configuration is that it shrouds the metal slide member when the drawer is in the locked position. In many appliance applications, including, e.g., those used in high-end kitchens, this is a desirable feature because it allows the drawer to hide the hardware.

In addition, with the above construction, the sliding member 122 typically can be easily removed and installed onto the drawer. Specifically, the bottom of the drawer, which sits on top of the support members 800, drags across the top of the support members as the sliding member 122 is locked and unlocked. The end of the sliding member 122, comprising a curved flange 430, comes into minimal contact with the housing 102. Since there is less friction between the sliding member and the support members, it takes less effort to remove and install the drawer onto the drawer member.

For the above-mentioned embodiments, the sliding member may be made of metal, and may be fabricated by an extrusion process or a roll form process, among others.

What has been described above includes examples of apparatuses, systems and corresponding methods illustrative of the disclosed subject matter. It is, of course, not possible to describe every combination of components or methods herein. One of ordinary skill in the art may recognize that many further combinations and permutations of the disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What has been described above includes examples of systems and methods illustrative of the disclosed subject matter. It is, of course, not possible to describe every combination of components or methods herein. One of ordinary skill in the art may recognize that many further combinations and permutations of the disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

In addition to the various implementations described herein, it is to be understood that other similar implementations can be used or modifications and additions can be made to the described implementation(s) for performing the same or equivalent function of the corresponding implementation(s) without deviating therefrom. Still further, multiple processing chips or multiple devices can share the performance of one or more functions described herein, and similarly, storage can be affected across a plurality of devices.

Accordingly, the description is not to be limited to any single implementation, but rather is to be construed in breadth, spirit and scope in accordance with the appended claims.

What is claimed is:

1. An apparatus, comprising:

a housing;

a wheel within the housing, wherein the wheel is configured to spin about an axis;

a group of split flaps hingeably disposed on an outer surface of the wheel;

a first tab and a second tab accessible via a first opening and a second opening, respectively, of a rear side of the housing, wherein the first tab and the second tab are projections within the housing, and wherein the first tab and the second tab are configured to receive a first latch and a second latch, respectively, when the first latch and the second latch are inserted into the first opening and the second opening, respectively;

a sliding member disposed with respect to at least one side of the housing, wherein the sliding member comprises a first end, a second end, and an elongated section, wherein the second end and at least a portion of the elongated section are disposed within the housing, wherein the sliding member is configured to be slidable from a first unlocked offset position to a second locked offset position, wherein, in the second locked offset position, the second end secures at least the first latch against the first tab, and wherein the sliding member is further configured to be slidable from the second locked offset position to the first unlocked offset position, wherein, in the first unlocked offset position, at least the first latch is unsecured from the first tab as a result of movement of the second end away from at least the first latch, enabling the apparatus to slide free of at least the first latch.

2. The apparatus of claim 1, wherein the apparatus is configured to slide free of at least the first latch at an angle with respect to an orthogonal direction from a surface comprising the first latch and the second latch.

3. The apparatus of claim 2, wherein the sliding member is disposed with respect to an interior surface of the side of the housing, and wherein, in the second locked offset position, the rear side of the housing is flush with a surface comprising the first latch and the second latch projecting from the surface.

4. The apparatus of claim 1, wherein, in the second locked offset position, the second end securing at least the first latch against the first tab further results in the second latch being pressed against the second tab to secure the second latch against the second tab, and wherein, in the second locked offset position, movement of the first latch is substantially prevented relative to the first tab and movement of the second latch is substantially prevented relative to the second tab.

5. The apparatus of claim 1, wherein, in the first unlocked offset position, the second latch disengages from the second tab, enabling the apparatus to slide free of the first latch and the second latch.

6. The apparatus of claim 1, wherein the sliding member is disposed parallel or substantially parallel to an interior surface of a top side of the housing.

7. The apparatus of claim 1, wherein the first end extends externally from a front side of the housing in a direction from the rear side of the housing to the front side of the housing.

8. The apparatus of claim 1, further comprising a motor disposed within the wheel, wherein the motor is operable to spin the wheel by different fixed amounts of angular rotation respectively corresponding to a split flap of the group of split flaps.

9. An apparatus, comprising:

a housing;

protrusion elements within the housing, the protrusion elements comprising a first mating element and a second mating element accessible via a first opening and a second opening, respectively, of the housing, wherein the first mating element and the second mating element are configured to receive a first extension from a mounting plate and a second extension from the mounting plate, respectively, wherein the first extension has a first geometry configured to match a first corresponding geometry of the first mating element, and wherein the second extension has a second geometry configured to match a second corresponding geometry of the second mating element;

a sliding lock slidable along a side of the housing, wherein the sliding lock comprises a first end, a second end, and an elongated section between the first end and the second end, wherein the second end and a portion of the elongated section are disposed within the housing, wherein the first end comprises a user interface element extendable from the housing configured to be pulled or pushed by external force, wherein, via the external force to the user interface element, the sliding lock is slidable between a first position and a second position, wherein, in the second position, the second end is pressed against a surface of the first extension, resulting in the first extension being pressed against, and mated to the first corresponding geometry of, the first mating element;

wherein, in the first position, the second end is withdrawn away from pressing on the surface of the first extension, resulting in the first corresponding geometry of the first mating element being unmated from the first geometry of the first extension, and further resulting in the second corresponding geometry of the second mating element being unmated from the second geometry of the second extension.

10. The apparatus of claim 9, wherein the first extension and the second extension comprise a first hook and a second hook, respectively, wherein at least the first extension comprises a raised collapsible rib, wherein the raised collapsible rib is configured to:

make contact with the second end of the sliding lock as the sliding lock slides from the first position to the second position, press against the second end of the sliding lock with a pressure as the sliding lock slides from the first position to the second position and facilitate the first extension being pressed against, and mated to the first corresponding geometry of, the first mating element, and collapse in proportion to an amount of the pressure in order not to prevent the second end from sliding over the surface into the second position.

11. The apparatus of claim 9, wherein at least the first extension comprises a raised element with a ramped end portion that facilitates sliding of the sliding lock between the first position and the second position, via the first ramped end portion making initial ramped contact with the second end of the sliding lock during sliding.

12. The apparatus of claim 9, wherein the sliding lock further comprises a bump, and wherein, in the first position, the bump snaps into a first depression of the housing near the first end, and wherein, in the second position, the bump snaps into a second depression of the housing near the first end, but farther than the first depression from the first end.

13. The apparatus of claim 9, wherein the first end comprises a curved flange, and wherein in the second position, the curved flange is flush or substantially flush with a front side of the housing.

14. The apparatus of claim 9, wherein, in the first position, the user interface element extends from the housing, wherein, as a result of the external force being a pushing force, the first end is moved according to the second position, and wherein, in the second position, the user interface element no longer extends substantially from the housing.

15. The apparatus of claim 9, wherein, in the first position, the housing is configured to disengage from the first extension and the second extension at an angle with respect to an orthogonal direction from a surface of the mounting plate.

16. The apparatus of claim 9, wherein the first mating element comprises a peak, a protruding flange that is parallel to the posterior side of the housing, and wherein the second mating element comprises a valley.

17. The apparatus of claim 9, wherein, in the second position, the second extension is pressed against, and mated to the second corresponding geometry of, the second mating element, wherein the second extension being mated to the second mating element comprises the second mating element resting on a top surface of the second extension as the second mating element is pressed against the second extension, and wherein securing the first extension against the first mating element comprises the first mating element being disposed under a bottom surface of the first extension as the first mating element is pressed against the first extension.

18. The apparatus of claim 9, wherein the sliding lock further comprises a tab projecting from an opening located adjacent to the first end, the tab being flush with the sliding lock, and the tab comprising a protruding bump.

* * * * *